US006127105A

United States Patent [19]

Vandenabeele

[11] Patent Number: 6,127,105

[45] Date of Patent: Oct. 3, 2000

[54] PHOTOGRAPHIC LIGHT-SENSITIVE MATERIAL WITH PRESERVED ANTISTATIC PROPERTIES

[75] Inventor: Hubert Vandenabeele, Mortsel, Belgium

[73] Assignee: AGFA-Gevaert, N.V., Mortsel, Belgium

[21] Appl. No.: 08/304,485

[22] Filed: Sep. 12, 1994

[30] Foreign Application Priority Data

Sep. 17, 1993 [EP] European Pat. Off. ..... 93202693

[51] Int. Cl.[7] ..... G03C 1/85

[52] U.S. Cl. ..... 430/527; 430/510; 430/523; 430/564; 430/966

[58] Field of Search ..... 430/527, 510, 430/523, 564, 966

[56] References Cited

U.S. PATENT DOCUMENTS 4,610,955 9/1986 Chen et al. ..... 430/527

5,252,445 10/1993 Timmerman et al. ..... 430/527

*Primary Examiner*—Christopher G. Young

*Attorney, Agent, or Firm*—Breiner & Breiner

[57] ABSTRACT

A photographic silver halide material is disclosed which comprises a support and on one or both sides thereof at least one silver halide emulsion layer and a protective antistress layer of hydrophilic colloid and which comprises in an outermost layer on the side(s) containing at least one emulsion layer a polyoxyalkylene compound as an antistatic agent, characterized in that said antistress layer comprises at least one synthetic clay. In addition to the preservation of antistatic properties after processing of the said material an improvement in surface glare as appreciated upon examination of medical X-ray films is obtained. Moreover the occurrence after processing of water spot defects and sticking is avoided.

13 Claims, No Drawings

PHOTOGRAPHIC LIGHT-SENSITIVE MATERIAL WITH PRESERVED ANTISTATIC PROPERTIES

FIELD OF THE INVENTION

The invention is related to a light-sensitive silver halide photographic material having an antistatic layer.

BACKGROUND OF THE INVENTION

It is well-known that a photographic film coated with hydrophilic colloid layers at one or two sides of the undercoat, e.g. a polyester undercoat, has a low conductivity due to the electric-insulating properties and becomes electrostatically charged by friction with dielectric materials and/or contact with electrostatically chargeable transport means, e.g. rollers. The charging occurs particularly easily in a relatively dry atmospheric environment, and especially with rapidly moving mechanical transport systems. The electrostatical charge that is accumulated may cause various problems due to the fact that it cannot be discharged gradually. As a consequence e.g. partial exposure of the photosensitive silver halide emulsion layers of the photographic material after an abrupt discharge may occur before development. This partial exposure results in the formation of dot-like or branch-like or feather-like spots after development of the photographic material.

In practice the photographic material is subjected to frictional contact with other elements during manufacturing, e.g. during a coating or cutting stage, and during use, e.g. during image-processing. Especially in the reeling-up or unreeling of dry photographic film in a camera high friction may build up, resulting in electrostatic charges that may attract dust or cause sparking. In unprocessed photographic silver halide emulsion materials sparking causes undesirable exposure marks and degrades the image quality.

These disturbing phenomena however cannot be observed prior to development. As this phenomenon is very irreproducible, difficulties arise for the quality control department to evaluate said photographic material.

In order to reduce electrostatic charging of a photographic material comprising a hydrophobic resin undercoat layer or support and at least one hydrophilic colloid layer on at least one side of said support without impairing its transparency it is known to apply coatings which are formed of or incorporate ionic compounds such as antistatic high molecular weight watersoluble polymeric compounds having ionic groups at frequent intervals in the polymer chain [ref. e.g. Photographic Emulsion Chemistry, by G. F. Duffin, —The Focal Press—London (1966)—Focal Press Limited, p. 168, U.S. Pat. No. 4,301,240].

Especially preferred antistatic compositions have been described in U.S. Pat. No. 4,610,955. These compositions comprise a hydrophilic binder, a surface active polymer having polymerized oxyalkylene monomers and an inorganic salt of organic tetrafluoroborates, perfluoroalkylcarboxylates, hexafluorophosphates and perfluoroalkyl carboxylates, said fluorinated surfactants leading to a good coating quality of the hydrophylic layers.

To minimize the electrostatic charge properties of photographic materials, especially the tribo-electrical charging causing electrostatical discharges and mechanical faults by transporting, it has been proposed according to EP 319 951 to use in the hydrophilic colloid layer a combination of three surfactants viz. an anionic fluorinated surfactant, a nonionic oxyalkyl compound and a nonionic oxyalkyl compound containing fluorine atoms.

Nevertheless a remaining problem is the preservation of the antistatic properties during storage of the photographic material for a long time after manufacturing, especially when said storage takes place in severe circumstances as e.g. at high temperature and high relative humidity.

A solution for the preservation problem of the antistatic properties may be offered by the coating of a thicker antistress layer with an increased amount of antistatic agents, e.g. polyoxyalkylene polymers. Although these increased amounts have the advantage of giving rise to more surface glare after processing, an inadmissable contamination or sludge formation in the coating step and, after exposure and development, may occur in the processing solutions. Moreover a thicker hydrophilic layer may retard the processing and drying velocity. This is obviously contradictory to the trend to develop rapid processing systems characterized by films with thin coating layers.

OBJECTS OF THE INVENTION

Therefor it is a first object of this invention to provide a photographic material having antistatic characteristics that are preserved after storage of said photographic material for a long time between manufacturing and processing, with minimum amounts of antistatic agent(s) and other additives coated in order to minimize the contamination of the processing solutions.

Further it is another object of this invention to improve the outlook of the film surface after processing of the thin coated gelatin layers, in particular by providing enough glare as appreciated upon examination of medical X-ray films and in addition by avoiding water spot defects and sticking.

Other objects will become apparent from the description hereinafter.

SUMMARY OF THE INVENTION

It has been found that the objects can be attained by a photographic silver halide material which comprises a support and on one or both sides thereof at least one silver halide emulsion layer and a protective antistress layer of hydrophilic colloid and which comprises in an outermost layer on the said side a polyoxyalkylene compound as an antistatic agent, characterised in that said antistress layer comprises at least one synthetic clay.

DETAILED DESCRIPTION

Natural clays are essentially hydrous aluminum silicates, wherein alkali metals or alkaline-earth metals are present as principal constituents. Also in some clay minerals magnesium or iron or both replace the aluminum wholly or in part. The ultimate chemical constituents of the clay minerals vary not only in amounts, but also in the way in which they are combined or are present in various clay minerals. It is also possible to prepare synthetic clays in the laboratory, so that more degrees of freedom can lead to reproducible tailor made clay products for use in different applications.

So from the natural clays smectite clays, including laponites, hectorites and bentonites are well-known. For the said smectite clays some substitutions in both octahedral and tetrahedral layers of the crystal lattice occur, resulting in a small number of interlayer cations. Smectite clays form a group of "swelling" clays which take up water and organic liquids between the composite layers and which have marked cation exchange capacities.

From these smectite clays, synthetic chemically pure clays have been produced. So e.g. preferred synthetic smectite clay additives for the purposes of this invention are LAPONITE RD and LAPONITE JS, trade mark products of LAPORTE INDUSTRIES Limited, London. Organophilic clays and process for the production thereof have been described in EP-Patent 161 411 B1.

LAPONITE JS is described as a synthetic layered hydrous sodium lithium magnesium fluoro-silicate incorporating an inorganic polyphoshate peptiser. The said fluoro-silicate appears as free flowing white powder and hydrates well in water to give virtually clear and colourless colloidal dispersions of low viscosity, also called "sols". On addition of small quantities of electrolyte highly thixotropic gels are formed rapidly. The said thixotropic gels can impart structure to aqueous systems without significantly changing viscosity. An improvement of gel strength, emulsion stability and suspending power can be observed by making use of it in the said aqueous systems. Further advantages are the large solid surface area of about 350 $m^2/g$ which gives excellent adsorption characteristics, its stability over a wide range of temperatures, its unique capability to delay gel formation until desired and its synergistic behaviour in the presence of thickening agents. Further, its purity and small particle size ensures an excellent clarity. In aqueous solutions of many polar organic solvents it works as a very effective additive.

LAPONITE RD is described as a synthetic layered hydrous sodium lithium magnesium silicate with analogous properties as LAPONITE JS.

Laponite clay as a synthetic inorganic gelling agent for aqueous solutions of polar organic compounds has been presented at the Symposium on "Gums and Thickeners", organised by the Society of Cosmetic Chemists of Great Britain, held at Oxford, on Oct. 14, 1969. In Laporte Inorganics Laponite Technical Bulletin L104/90/A a complete review about the structure, the chemistry and the relationship to natural clays is presented. Further in Laporte Inorganics Laponite Technical Bulletin L106/90/c properties, preparation of dispersions, applications and the product range are disclosed. A detailed description of "Laponite synthetic swelling clay, its chemistry, properties and application" is given by B. J. R. Mayes from Laporte Industries Limited.

In the antistress layer(s) comprising the synthetic clay(s) described hereinbefore, hydrophilic colloid binders that can be homogeneously mixed therewith are e.g. proteinaceous colloids, e.g. gelatin, polysaccharide, and synthetic substitutes for gelatin as e.g. polyvinyl alcohol, poly-N-vinyl pyrrolidone, polyvinyl imidazole, polyvinyl pyrazole, polyacrylamide, polyacrylic acid, and derivatives thereof. Furthermore the use of mixtures of said hydrophilic colloids is not excluded. Among these binders the most preferred is gelatin. Conventional lime-treated or acid treated gelatin can be used. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, N° 16, page 30 (1966). To minimize the amount of gelatin, however can be replaced in part or integrallly by synthetic polymers as cited hereinbefore or by natural or semi-synthetic polymers. Natural substitutes for gelatin are e.g. other proteins such as zein, albumin and casein, cellulose, saccharides, starch, and alginates. Semi-synthetic substitutes for gelatin are modified natural products as e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates.

According to a preferred embodiment of this invention the synthetic clay(s) as defined above are applied in an amount of at least 10% by weight versus the amount of hydrophilic colloid present in the antistress layer(s). Specifically useful amounts of the said synthetic swelling clays present in the protective antistress layer in accordance with this invention are in the range from 0.10 to 0.50 per $m^2$ and more preferably from 0.10 to 0.25 $g/m^2$.

A preferred protective antistress layer is made from gelatin hardened up to a degree corresponding with a water absorption of less than 2.5 grams of water per $m^2$. The gelatin coverage in the protective layer is preferably not higher than about 1.20 g per $m^2$ and is more preferably in the range of 1.20 to 0.60 g per $m^2$.

It has further been established that the water absorption of the hydrophilic layers due to filler loadings as the synthetic smectitite swelling clays according to this invention is not increased.

In a preferred embodiment gelatin in the antistress layer is partially replaced by colloidal silica as it gives rise to a further improvement of the obtained properties according to this invention. Preferably colloidal silica having an average particle size not larger than 10 nm and with a surface area of at least 300 $m^2$ per gram is used, the colloidal silica being present at a coverage of at least 50 mg per $m^2$. Further the coverage of said colloidal silica in the antistress layer is preferably in the range of 50 mg to 500 mg per $m^2$. Particularly good results which are fully in accordance with this invention are obtained by using an antistatic layer consisting for at least 50% by weight of colloidal silica versus the preferred ionic polymer latex described hereinbefore. Especially preferred colloidal silica particles have a surface area of 500 m2 per gram and an average grain size smaller than 7 nm. Such type of silica is sold under the name KIESELSOL 500 (KIESELSOL is a registered trade name of Bayer AG, Leverkusen, West-Germany).

In admixture with the hardened gelatin the antistress layer may further contain friction-lowering substance(s) such as dispersed wax particles (carnaubawax or montanwax) or polyethylene particles, fluorinated polymer particles, silicon polymer particles etc. in order to further reduce the sticking tendency of the layer especially in an atmosphere of high relative humidity.

The gelatin binder can be forehardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as The synthetic clays cited hereinbefore are optionally added in addition to non-ionic surfactant(s) having antistatic characteristics that is(are) present in the outermost layer at side of the support where the emulsion layer(s) has(have) been coated.

As non-ionic surfactant(s) having antistatic characteristics any of the generally known polyalkylene oxide polymers is useful as antistatic agent. Suitable examples of alkylene oxides are e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides. Preferred antistatic agents are polyoxyethylene compounds. A more preferred antistatic agent corresponds to formula (I)

$$R—O—(CH_2CH_2O)_n—H \quad (I)$$

wherein n is an integer of at least 4 preferably between 8 and 30 and R represents a long chain alkyl or alkylaryl group having at least 10 C-atoms as e.g. oleyl.

According to this invention in a preferred embodiment the antistatic coating is applied as an outermost coating, e.g. as protective layer at the silver halide emulsion layer side of a photographic silver halide emulsion layer material. In another preferred embodiment the protective antistress layer, optionally comprising antistatic agent(s), is covered with a gelatin free antistatic afterlayer comprising the polyoxyalkylene compound.

The coating of the said gelatin free antistatic layer, as well as the coating of the antistress layer may proceed by any coating technique known in the art, e.g. by doctor blade coating, air knife coating, curtain coating, slide hopper coating or meniscus coating, which are coating techniques known from the production of photographic silver emulsion layer materials. Moreover the spray coating technique, known from U.S. Pat. No. 4,218,533, may be applied.

Any thickening agent may be used so as to regulate the viscosity of the solution used for any of the said coating techniques provided that they do not particularly affect the photographic characteristics of the silver halide light-sensitive photographic material. Preferred thickening agents include aqueous polymers such as polystyrene sulphonic acid, sulphuric acid esters, polysaccharides, polymers having a sulphonic acid group, a carboxylic acid group or a phosphoric acid group, polyacrylamide, polymethacrylic acid or its salt, copolymers from acrylamide and methacrylic acid and salts derived thereof, copolymers from 2-acrylamido-2-methyl-propansulphonic acid, polyvinyl alcohol, alginate, xanthane, carraghenan and the like. Polymeric thickeners well-known from the literature resulting in thickening of the coating solution may be used independently or in combination. Patents concerning thickening agents are U.S. Pat. No. 3,167,410, Belgian Patent No. 558.143, JP OPI Nos. 53-18687 and 58-36768 and DE 3,836,945. As a preferred polymeric thickener use can be made of the product characterized by formula (II)

(II)

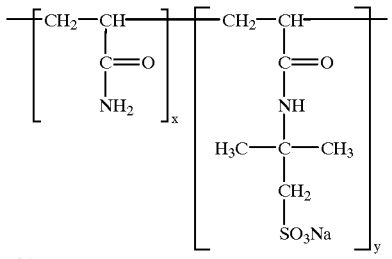

with x/y = 24/76.

The gelatin-free antistatic afterlayer may further comprise spacing agents and coating aids such as wetting agents as e.g. perfluorinated surfactants. Spacing agents which may also be present in the protective antistress layer in generally have an average particle size which is comprised between 0.2 and 10 $\mu$m. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

It has now quite unexpectedly been found that according to this invention the presence of at least synthetic clay in the protective antistress coating, and, optionally, in the afterlayer coated thereover, provides the preservation of good antistatic properties of the material. Moreover the absence of water spot defects for the dry film after processing can be observed as well as the appearance of an improved surface glare. Even for thin coated layers for applications in rapid processing conditions the same advantages can be recognized. Furthermore the appearance of sludge in the processing is significantly reduced as well in hardener free as in hardener containing processing solutions.

A common support of a photographic silver halide emulsion material is a hydrophobic resin support or hydrophobic resin coated paper support. Hydrophobic resin supports are well known to those skilled in the art and are made e.g. of polyester, polystyrene, polyvinyl chloride, polycarbonate, preference being given to polyethylene terephthalate.

The hydrophobic resin support may be provided with one or more subbing layers known to those skilled in the art for adhering thereto a hydrophilic colloid layer. Suitable subbing layers for polyethylene terephthalate supports are described e.g. in U.S. Pat. Nos. 3,397,988, 3,649,336, 4,123,278 and 4,478,907.

Photographic silver halide emulsion materials, containing at least one silver halide emulsion layer and as an antistatic outermost layer a protective antistress layer according to this invention and an optionally present afterlayer, may be of any type known to those skilled in the art. For example, the said antistatic outermost layer is useful in materials for continuous tone or halftone photography, microphotography and radiography, in black-and-white as well as colour photographic materials.

It is clear that also single side coated materials can be prepared according to this invention. In that case the single side coated photographic material comprises a support and on one side thereof at least one silver halide emulsion layer and a protective gelatin antistress layer containing an ionic or non-ionic polymer or copolymer latex and in an outermost coating on the said side a polyoxyalkylene compound wherein on the other side an outermost layer is present comprising a said ionic or non-ionic polymer and a said polyoxyalkylene compound. In the back coated layer(s) one or more antihalation dyes can be present either in the said outermost coating or in an underlying back coating or in both of them.

Antihalation dyes are non-spectrally sensitizing dyes which are widely used in photographic elements to absorb reflected and scattered light. Examples of the said dyes have been described e.g. in U.S. Pat. Nos. 3,560,214; 4,857,446 and in EP-Applications 92.202.767 and 92.202.768. The filter dye(s) can be coated in layers of photographic elements in the form as has been described in EP 0,384,633 A2; EP 0,323,729 A2; EP 0,274,723 B1, EP 0,276,566 B1, EP 0,351,593 A2; in U.S. Pat. Nos. 4,900,653; 4,904,565; 4,949,654; 4,940,654; 4,948,717; 4,988,611 and 4,803,150; in Research Disclosure 19551 (July 1980); in EP 0,401,709 A2 and in U.S. Pat. No. 2,527,583, these examples being not limitative.

By using a recording material having a composition according to the present invention problems as preservation of antistatic characteristics before processing, water spot defects and insufficient glare after processing in automatic processing machines can be avoided or substantially reduced.

Such means for example that the formation of static charges by contact of a silver halide emulsion layer side with the rear side of the recording material or caused by friction with substances such as rubber and hydrophobic polymeric binder, e.g. the binder constituent of phosphor screens used as X-ray intensifying screens, can be markedly reduced by employing the present antistatic layer. The building up of static charges and subsequent dust attraction and/or sparking, e.g. during loading of films in cassettes, e.g. X-ray cassettes, or in cameras, or during the taking or projection of a sequence of pictures as occurs in automatic cameras or film projectors is prevented.

The following examples illustrate the present invention without however limiting it thereto.

EXAMPLES

Example 1

An X-ray photographic material was provided with an antistatic layer as a gelatin free outermost layer on top of the protective antistress layer covering the silver halide emulsion layer.

Use was made of the slide hopper coating technique for simultaneous application of the emulsion layer, the antistress layer and the antistatic coating.

The composition of said outermost layer was as follows:

an ammoniumperfluorocarbonate compound represented by the formula $F_{15}C_7COONH_4$ a polyoxyethylene compound represented by the formula (I)

$$R—O—(CH_2CH_2O)_n—H \quad (I)$$

with n=10 and R=oleyl and a polymeric thickener represented by the formula (II)

(II)

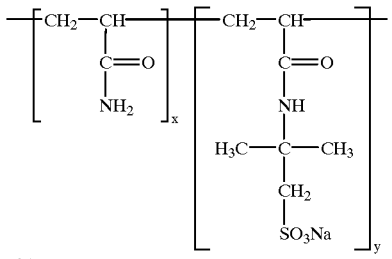

with x/y = 24/76.

The three products were added to an aqueous solution containing up to 10% of ethyl alcohol with respect to the finished solution, ready for coating. Said three products were present in an amount of 0.75 g/l, 7.5 g/l and 6.5 g/l respectively and coated in an amount of 6.0 mg/m$^2$, 60.0 mg/m$^2$ and 52.0 mg/m$^2$ respectively. The amount of ethyl alcohol was evaporated during the coating and drying procedure of the antistatic layer.

The antistress layer was coated with the following compounds, expressed in grams per square meter per side:

| | |
|---|---|
| gelatin | 1.10 |
| polymethylmethacrylate (average particle diameter: 6 $\mu$m) | 0.023 |
| 1-p-carboxyphenyl-4,4'-dimethyl-3-pyrazolidine-1-one | 0.054 |
| $C_{17}H_{15}$—CO—NH—($CH_2$—$CH_2$—O—)$_{17}$—H | 0.0188 |
| formaldehyde | 0.1 |

The resulting material is the comparative coating No. 1 in Table 1.

In a coating according to the present invention, an amount of 0.165 g/m$^2$ of LAPONITE JS was added to the protective antistress layer. The resulting material is the inventive coating No. 2 in Table 2.

In a further coating, inventive coating No. 3 was prepared with the same ingredients as in coating No. 2 except for the extra addition of 0.188 g/m$^2$ OF KIESELSOL 500 to the protective antistress layer.

As an objective evaluation of the antistatic properties the surface resistivity was measured before processing.

A comparison was made between the lateral surface resistivity of a freshly prepared photographic material and said material after storing for 36 hours in a conditioned atmosphere of 57° C. and 34% RH (relative humidity).

The lateral surface resistance is indicated as LSR in Table 1, taken as a representive parameter to characterize the antistatic properties of the material, was expressed in ohm/square (ohm/sq.) and was measured by a test proceeding as follows:

two conductive copper poles having a length of 10 cm parallel to each other were placed at a distance of 1 cm onto the surface to be tested and the resistance built up between said electrodes was measured with a precision ohm-meter. By multiplying the thus determined ohm value with the factor 10 the surface resistance value expressed as ohm/square (ohm/sq) was obtained.

Moreover the presence of water spot defects and of sticking defects after processing was qualitatively evaluated as "good" or "bad", "bad" being indicated as soon as "drip marks" were visually observed after processing in the case of the water spot defect evaluation or as soon as "sticking flecks" were visually observed after processing and piling up a series of films of the same coating The processing conditions and the composition of the processing solutions is given hereinafter:

the processing of the described photographic materials in accordance with this invention proceeds in the processing machine CURIX HT530 (Agfa-Gevaert trademarked name) with the following time (in seconds) and temperature (in °C.) characteristics:

| | | |
|---|---|---|
| loading | 0.2 sec. | |
| developing | 9.3 sec. | 35° C. in developer I described below |
| cross-over | 1.4 sec. | |
| rinsing | 0.9 sec. | |
| cross-over | 1.5 sec. | |
| fixing | 6.6 sec. | 35° C. in fixer I described below |
| cross-over | 2.0 sec. | |
| rinsing | 4.4 sec. | 20° C. |
| cross-over | 4.6 sec. | |
| drying | 6.7 sec. | |
| total | 37.6 sec. | |

Composition of Developer I concentrated part:

| | |
|---|---|
| water | 200 ml |
| potassium bromide | 12 grams |
| potassium sulphite (65% solution) | 249 grams |
| ethylenediaminetetraacetic acid, sodium salt,trihydrate | 9.6 grams |
| hydroquinone | 106 grams |
| 5-methylbenzotriazole | 0.076 grams |
| 1-phenyl-5-mercaptotetrazole | 0.040 grams |
| sodiumtetraborate (decahydrate) | 70 grams |
| potassium carbonate | 38 grams |
| potassium hydroxide | 49 grams |
| diethylene glycol | 11 grams |
| potassium iodide | 0.088 grams |
| 4-hydroxymethyl-4methyl-1phenyl-3-pyrazolidinone | 12 grams |

Water to make 1 liter pH adjusted to 11.15 at 25° C. with potassium hydroxide.

For initiation of the processing one part of the concentrated developer was mixed with 3 parts of water.

No starter was added.

The pH of this mixture was 10.30 at 25° C.

Composition of the Fixer concentrated part:

| | |
|---|---|
| ammonium thiosulfate (78% solution) | 661 grams |
| sodium sulphite | 54 grams |
| boric acid | 25 grams |
| sodium acetate-trihydrate | 70 grams |
| acetic acid | 40 grams |

water to make 1 liter pH adjusted with acetic acid to 5.30 at 25° C.

To make this fixer ready for use one part of this concentrated part was mixed with 4 parts of water. A pH of 5.25 was measured at 25° C.

Further after the materials were dried in the drying unit of the processor the surface gloss or glare (GLARE in the Table) was measured. Therefor use was made of the measurement technique with a reflectometer as described in ASTM D523, 1985, corresponding with DIN 67530 (01.82) and ISO 2813 (1978) wherein reflections are measured at values of the reflection angles of 20°, 60° and 85°, depending on the glare of the surfaces. Measurement takes place at reflection angles of 20° in the case of high gloss, at 60° for moderate gloss and at 85° for low gloss.

TABLE 1

| Coating No. | LSR × $10^{10}$ Ohm/square Fresh | LSR × $10^{10}$ Ohm/square After 36 h | Water spot defects | GLARE 20° | GLARE 60° | C.A. (°) |
|---|---|---|---|---|---|---|
| 1(comp.) | 28 | 11000 | bad | 2.3 | 26.5 | 44 |
| 2(inv.) | 30 | 54 | +/− good | 3.1 | 34.6 | 33 |
| 3(inv.) | 93 | 360 | good | 6.5 | 54.8 | 28 |

As can be seen from Table 1 a remarkable improvement is observed in antistatic properties, for the freshly prepared and for the stored material if synthetic LAPONITE clay is present as an additive in the protective antistress layer. A further improvement, especially concerning water spot defects and surface glare is realized if fine silica particles are added in addition.

The same results concerning water spot defects and sticking are obtained if the processing solutions contain a hardening compound as glutar dialdehyd in the developer solution and aluminum sulphate in the fixer.

Example 2

The same material as in Example 1 was coated as coating No. 3 (comparative), except for the presence of a matting agent having the composition of a copolymer of styrene, methylmethacrylate, $C_{18}$-methacrylate and maleic acid. To the protective antistress coating in coating No. 4 0.167 g/$m^2$ of LAPONITE JS was added.

In Table 2 values of the surface resistivity for the freshly coated material and after preservation of the material for 36 hours is summarized.

TABLE 2

| Coating No. | LSR × $10^{10}$ Ohm/square Fresh | LSR × $10^{10}$ Ohm/square After 36 h |
|---|---|---|
| 3(comp.) | 200 | 14000 |
| 4(inv.) | 26 | 43 |

As can be seen from Table 2 an unexpected improvement is observed in antistatic properties, for the freshly prepared and for the stored material if the synthetic LAPONITE clay is added to the protective layer. A preservation of the anitistatic properties can thus better be realized in the presence of the clay additive in the protective antistress layer.

Example 3

In this Example the same data were summarized for the materials as in Example 1 coated without afterlayer. So coating Nos. 5 to 7 in Example 3 are the same as in Example 1, except for the absence of an afterlayer coated over the antistress layer. Further coatings Nos. 9 and 9 were added, with higher amounts of respectively 0.263 g/$m^2$ of colloidal silica KIESELSOL 500 for No. 8 and 0.248 g/$m^2$ of synthetic LAPONITE JS clay for No. 9, added to the protective antistress coating.

TABLE 3

| Coating No. | LSR × $10^{10}$ Ohm/square Fresh | LSR × $10^{10}$ Ohm/square After 36 h | Water spot defects | GLARE 20° | GLARE 60° | C.A. (°) |
|---|---|---|---|---|---|---|
| 5(comp.) | 2300 | 40000 | bad | 2.3 | 25.7 | 63 |
| 6(inv.) | 1200 | 4800 | good | 11.2 | 53.5 | 56 |
| 7(inv.) | 830 | 6000 | good | 16.4 | 59.6 | 33 |
| 8(inv.) | 680 | 5500 | good | 19.1 | 61.8 | 40 |
| 9(inv.) | 760 | 32000 | good | 19.0 | 61.7 | 33 |

From Table 3 it is apparent that the absence of an antistatic afterlayer makes the lateral resistivity to increase. Nevertheless the effects obtained relating to surface glare and water spot defects remain.

Example 4

In this Example the coating composition No. 1 from Example 1 was prepared as a comparative example, with 1.1 gram of gelatin per square meter in the protective antistress coating (coating No. 10). In coating No. 11 the amount of gelatin was decreased to 0.6 g/$m^2$.

A further coating No. 12 was prepared with the same ingredients as for coating No. 11 except for the extra addition of 0.212 g/$m^2$ of KIESELSOL 500 to the protective antistress layer.

In coating No. 13 according to the present invention, an amount of 0.165 g/m2 of LAPONITE JS was added additionally to the antistress layer composition from coating No. 12.

After processing as described in Example 1 sticking defects were qualitatively evaluated and defined as "good" or "bad", being "bad" as soon as "sticking flecks" were visually observed after processing and piling up a series of films of the same coating material.

TABLE 4

Evaluation of sticking defects

| Coating No. | Sticking defects |
|---|---|
| 10(comp.) | bad |
| 11(comp.) | bad |
| 12(comp.) | rather good |
| 13(inv.) | good |

As can be from Table 4 an improvement is observed in antisticking properties as soon as colloidal silica is added to the protective antistress coating but the best results are obtained if the thin protective antistress coating also contains LAPONITE JS as a synthetic smectite clay in accordance with this invention.

What is claimed is:

1. A photographic silver halide material which comprises a support and on one or both sides thereof at least one silver halide emulsion layer and a protective antistress gelatin layer containing a synthetic clay wherein the said protective antistress layer or a gelatin free antistatic afterlayer, coated over said antistress layer comprises a polyoxyalkylene compound as an antistatic agent.

2. A photographic material according to claim 1 comprising a support and on one side thereof at least one silver halide emulsion layer and a protective antistress layer of hydrophilic colloid containing a synthetic clay and in an outermost coating on the said side a polyoxyalkylene compound wherein on the other side an outermost layer is present comprising a said synthetic clay and a said polyoxyalkylene compound.

3. A photographic material according to claim 2 wherein on the said other side one or more antihalation dyes are coated in the said outermost coating, in an underlying back coating or in both of them.

4. A photographic silver halide material according to claim 1, wherein the said polyoxyalkylene compound is present in a substantially gelatin free surface layer coated over the said antistress layer.

5. A photographic silver halide material according to claim 1, wherein the said polyoxyalkylene compound is a polyoxyethylene compound.

6. A photographic silver halide material according to claim 1, wherein the said synthetic clay is a synthetic smectite clay.

7. A photographic silver halide material according to claim 1, wherein the said synthetic clay is present in an amount of at least 10% by weight versus the amount of hydrophilic colloid present in the antistress layer(s).

8. A photographic silver halide material according to claim 1, wherein the amount of synthetic clay present in the protective antistress layer(s) is in the range from 0.10 to 0.50 g/$m^2$.

9. A photographic silver halide material according to claim 1, wherein the amount of synthetic clay present in the protective antistress layer(s) is in the range from 0.10 to 0.25 g/$m^2$.

10. A photographic silver halide material according to claim 1, wherein in the said antistress layer(s), the amount of hydrophilic colloid coated is less than 1.2 g/$m^2$.

11. A photographic silver halide material according to claim 1, wherein colloidal silica particles are present in the antistress layer(s) in an amount of 50 to 500 mg/$m^2$.

12. A photographic silver halide material according to claim 11, wherein colloidal silica particles have a surface area of 500 m2 per gram and an average grain size smaller than 7 nm.

13. A photographic material according to claim 1, wherein said photographic material is a medical X-ray material.

* * * * *